US012668931B2

(12) United States Patent
Jackson

(10) Patent No.: US 12,668,931 B2
(45) Date of Patent: Jun. 30, 2026

(54) SYSTEM AND METHOD FOR DETERMINING A PICKLEBALL BOUNCE POINT DURING PICKLEBALL PLAY

(71) Applicant: Arthur M. Jackson, Marietta, GA (US)

(72) Inventor: Arthur M. Jackson, Marietta, GA (US)

( * ) Notice: Subject to any disclaimer, the term of this patent is extended or adjusted under 35 U.S.C. 154(b) by 0 days.

(21) Appl. No.: 18/734,518

(22) Filed: Jun. 5, 2024

(65) Prior Publication Data

US 2024/0410116 A1 Dec. 12, 2024

Related U.S. Application Data

(60) Provisional application No. 63/506,364, filed on Jun. 6, 2023.

(51) Int. Cl.
*E01C 13/06* (2006.01)
*A63B 67/00* (2006.01)

(52) U.S. Cl.
CPC ..... *E01C 13/065* (2013.01); *A63B 67/002* (2013.01)

(58) Field of Classification Search
CPC . A63B 24/00; A63B 24/0062; A63B 24/0021; A63B 67/002; A63B 71/0608; A63B 71/06; A63B 71/0605; A63B 2071/0611; A63C 19/12; A63C 19/065; E01C 13/065
USPC ..... 472/92–94
See application file for complete search history.

(56) References Cited

U.S. PATENT DOCUMENTS 3,883,860 A * 5/1975 von Kohorn ..... A63B 71/0605 340/323 R
2007/0249435 A1* 10/2007 Rodengen ..... A63B 71/0608 473/490
2007/0259598 A1* 11/2007 Ribi ..... C08L 75/04 446/385
2013/0017948 A1* 1/2013 Charlson ..... G02B 26/007 503/201
2018/0117402 A1* 5/2018 Meetin ..... A63B 24/0062
2018/0200608 A1* 7/2018 Sadick ..... B32B 5/022
2021/0180266 A1* 6/2021 Pallenberg ..... E01C 11/005
2021/0322860 A1* 10/2021 Muñoz Turowiecki ..... A63C 19/065

FOREIGN PATENT DOCUMENTS

WO WO-2018115658 A1 * 6/2018 ..... C09D 5/00

OTHER PUBLICATIONS

Sandrine Perruchas, Molecular Copper Iodide Clusters: A Distinguishing Family of Mechanochromic Luminescent Compounds, Dalton Transactions, 2021, pp. 12031-12044, 50 (35).

(Continued)

*Primary Examiner* — Michael D Dennis

(57) ABSTRACT

A coating, for example a piezochromic coating, can adhere to a pickleball court. The coating can mark a pickleball bounce point during pickleball play on the pickleball court. When a pickleball bounces from a coated surface of the pickleball court, the pickleball can produce a mark on or in the coating at the bounce point. The mark can provide a visible indication of location of the bounce point that informs whether the bounce point was in an in-bounds or an out-of-bounds area of the pickleball court. The coating can thus help players and/or referees determine who prevailed in a volley or won a point during a pickleball game.

15 Claims, 8 Drawing Sheets

(56) References Cited

OTHER PUBLICATIONS

Hakuba Kitagawa, Yoshiki Ozawa, and Koshiro Toriumi, Flexibility of Cubane-Like Cu4I4 Framework: Temperature Dependence of Molecular Structure and Luminescence Thermochromism of [Cu4I3(PPh3)4] in Two Polymorphic Crystalline States, Chemical Communications, 2010, pp. 6302-6304, (46).

* cited by examiner

Cross Section at A-A

SYSTEM AND METHOD FOR DETERMINING A PICKLEBALL BOUNCE POINT DURING PICKLEBALL PLAY

CROSS REFERENCE TO RELATED APPLICATIONS

This application claims priority to U.S. Provisional Patent Application No. 63/506,364, filed Jun. 6, 2023 in the name of Arthur M. Jackson and entitled "System and Method for Determining a Pickleball Bounce Point," the entire contents of which are hereby incorporated herein by reference.

TECHNICAL FIELD

Embodiments of the technology relate generally to coatings and piezochromic coatings and more particularly to a coating for a pickleball court that can mark a pickleball bounce point during pickleball play.

BACKGROUND

In many respects, conventional technologies underserve sports in which opposing players volley an object back and forth while attempting to keep the object in-bounds, such as pickleball, tennis, volleyball, badminton, paddle ball, racquetball, squash, table tennis, etc. For instance, need exists in connection with determining whether the object is in-bounds or out-of-bounds when the object strikes a playing surface.

Need further exists for determining whether a pickleball has bounced in-bounds or out-of-bounds during a pickleball game.

Need further exists for improvement in piezochromic coating systems.

The aforementioned needs are representative rather than exhaustive. A technology addressing one or more of the needs discussed above, or some related deficiency in the art, would benefit sports, coatings, and/or piezochromic systems. As will be appreciated by those having skill in the art, the disclosure provided herein includes written description containing clear, exact terms to enable carrying out embodiments meeting the foregoing needs.

SUMMARY

A playing area, for instance a court, can be configured so that when an object in play strikes a point on a surface, a mark appears at the point.

In some aspects of the disclosure, the court can comprise a pickleball court, the object can comprise a pickleball, and the mark can comprise a color change at the strike point. In some aspects of the disclosure, the strike point comprises a bounce point.

In some aspects of the disclosure, configuring the court can comprise applying a piezochromic coating to the court. The piezochromic coating can adhere to the court, for example.

In some aspects of the disclosure, the mark can fade with time and/or the color change can be reversible.

In some aspects of the disclosure, an application of heat can reverse the color change.

In some aspects of the disclosure, once the mark fades and/or the color change reverses, the court can return to its original state; so if the pickleball strikes the same point on the surface, a new mark can appear.

In some aspects of the disclosure, the coating can undergo a permanent change at the strike point. The permanent change may inhibit or interfere with marking of a second strike at the same point. Or, the first strike may leave a first mark comprising a first color that is visibly distinct from the original color of the coating, and the second strike may leave a second mark on top of the first mark that comprises a second color that is visibly distinct from the first color. That is, two successive strikes to the same point may produce a greater color change than a single strike. Fresh coating can be sprayed, brushed, rolled, dabbed, or otherwise applied where marking capability is inhibited or where markings may be obscured, in a touch-up or spot-treatment manner, thereby restoring marking capability.

The foregoing discussion about marking strike points or bounce points is for illustrative purposes only. Various aspects of the present disclosure may be more clearly understood and appreciated from a review of the following text and by reference to the associated drawings and the claims that follow. This Summary does not intend to be exhaustive, nor does it intend to enumerate each and every aspect of the disclosure. Other aspects, systems, methods, features, advantages, and objects of the present disclosure will become apparent to those with skill in the art upon examination of the following drawings and text. It is intended that all such aspects, systems, methods, features, advantages, and objects are to be included within this description and covered by this paper and by the appended claims.

Figure 1A:
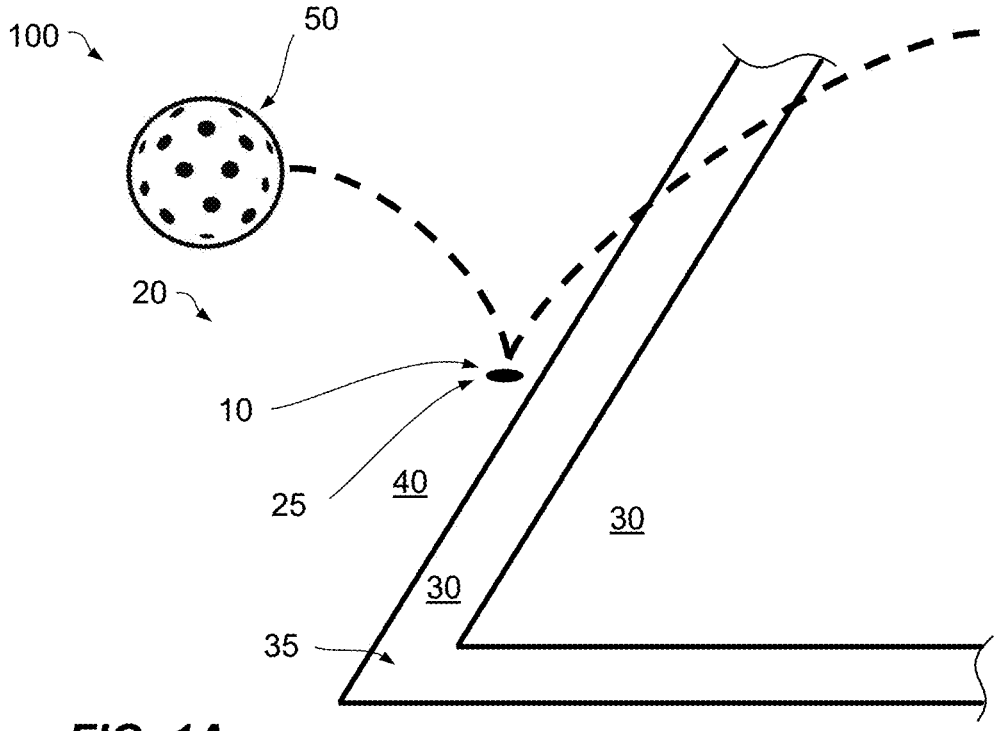
FIGS. 1A, 1B, 1C, 1D, 1E, and 1F (collectively FIG. 1) are illustrations of a system for marking a pickleball bounce point during pickleball play in accordance with some example embodiments of the disclosure.

Many aspects of the disclosure can be better understood with reference to these figures. The elements and features shown in the figures are not necessarily to scale, emphasis being placed upon clearly illustrating principles of example embodiments of the disclosure. Moreover, certain dimensions and features may be exaggerated to help visually convey such principles. In the figures, reference numerals often designate like or corresponding, but not necessarily identical, elements throughout the several views.

DETAILED DESCRIPTION OF EXAMPLE EMBODIMENTS

The technology will be discussed more fully below with reference to the Figures, which provide additional information regarding representative or illustrative embodiments of the disclosure. The present technology can be embodied in many different forms and should not be construed as limited to the embodiments set forth herein; rather, these embodiments are provided so that this disclosure will be thorough and complete, and will fully convey the scope of the technology to those having ordinary skill in the art. Furthermore, all "examples," "embodiments," and "exemplary embodiments" provided herein are intended to be non-limiting and among others supported by representations of the disclosure.

Those of ordinary skill in the art having benefit of this disclosure will be able, without undue experimentation, to combine compatible elements and features that are described at various places in this written description, which includes text and illustrations. That is, the illustrations and specification are organized to facilitate practicing numerous combinations, such as by combining an element of one illustrated embodiment with another element of another illustrated embodiment or by combining a feature disclosed in an early paragraph of the specification with another element disclosed in a later paragraph of the specification.

This document includes sentences, paragraphs, and passages (some of which might be viewed as lists) disclosing alternative components, elements, features, functionalities, usages, operations, steps, etc. for various embodiments of the disclosure. Unless clearly stated otherwise, all such lists, sentences, paragraphs, passages, and other text are not exhaustive, are not limiting, are provided in the context of describing representative examples and variations, and are among others supported by various embodiments of the disclosure. Accordingly, those of ordinary skill in the art having benefit of this disclosure will appreciate that the disclosure is not constrained by any such lists, examples, or alternatives. Moreover, the inclusion of lists, examples, embodiments, and the like (where provided as deemed beneficial to the reader) may help guide those of ordinary skill in practicing many more implementations and instances that embody the technology without undue experimentation, all of which are intended to be within the scope of the claims.

This disclosure includes figures and discussion in which features and elements of certain embodiments may be organized into what might be characterized as functional units, blocks, subsystems, or modules. And, certain processes and methods may be organized into blocks or into steps. Such organization is intended to enhance readership and to facilitate teaching the reader about working principles of the technology and about making and using an abundance of embodiments of the disclosure. The organization is not intended to force any rigid divisions or partitions that would limit the disclosure. In practice, the flexibility of the technology and the depth of this disclosure supports dispersing or grouping functionalities, elements, and features in many different ways. The inclusion of an element or function in one block, unit, module, or subsystem verses another may be substantially arbitrary in many instances, with the divisions being soft and readily redrawn using ordinary skill in combination with the teaching provided herein. Accordingly, functional blocks, modules, subsystems, units, and the like can be combined, divided, repartitioned, redrawn, moved, reorganized, or otherwise altered without deviating from the scope and spirit of the disclosure. This is not to say that, nor will it support a conclusion that, any disclosed organizations and combinations are not novel, are not inventive, or are obvious.

Certain steps in the processes and methods disclosed or taught herein, may naturally need to precede others to achieve desirable functionality. However, the disclosure is not limited to the order of the described steps if such order or sequence does not adversely alter functionality to the extent of rendering the technology inoperable or nonsensical. That is, it is recognized that some steps of a process or method may be performed before or after other steps or in parallel with other steps without departing from the scope and spirit of the disclosure.

In some instances, a process or method (for example that entails using, making, or practicing) may be discussed with reference to a particular illustrated embodiment, application, or environment. For example, a flowchart may reference or be discussed with reference to a figure. Those of skill in the art will appreciate that any such references are by example and are provided without limitation. Accordingly, the disclosed processes and methods can be practiced with other appropriate embodiments supported by the present disclosure and in other appropriate applications and environments. Moreover, one of ordinary skill in the art having benefit of this disclosure will be able to practice many variations of the disclosed and flowcharted methods and processes as may be appropriate for various applications and embodiments.

The term "couple," as used herein, generally refers to joining, linking, connecting, or associating something with something else. When two things couple or something couples with something else, they may directly couple or indirectly couple via another, intervening component, element, or module. A first component may couple to or with a second component via the first component comprising the second component. Moreover, a first thing can couple to or with a second thing without physical contact, for example optically or via sound. The term can thus be read with a plain and ordinary meaning.

The term "coupled," as used herein in a context of a first thing being coupled to or with a second thing, generally refers to the first thing being joined, linked, connected, or associated to or with the second thing. When something is coupled to or with something else, they may be directly coupled or indirectly coupled via another, intervening component, element, or module. Moreover, a first component may be coupled to or with a second component via the first component comprising the second component. A first thing can be coupled to or with a second thing without physical contact, for example optically or via sound. The term can thus be read with a plain and ordinary meaning.

The term "operably coupled," as used herein in the context of two things being operably coupled, generally refers to the two things being coupled in a way that allows, supports, or facilitates something to work or operate. The term can thus be read with an ordinary and customary meaning.

When the terms "a" or "an" are used herein, one or more is to be generally understood, except when more than one would be nonsensical in context or would adversely alter functionality to the extent of rendering technology inoperable.

As one of ordinary skill in the art will appreciate, each of the terms "approximate" and "approximately," as used herein, provides an industry-accepted tolerance for the associated term modified. Such industry-accepted tolerances range from less than one percent to ten percent and correspond to, but are not limited to, component values, dimensions, volumes, weights, signal levels, process variations, operational targets, and manufacturing tolerance.

The terms "substantial" and "substantially," as used herein, are words of degree accommodating deviations that a skilled artisan would recognize as unintentional deviation from a target value or as inconsequential.

In each instance in which a number is disclosed for an embodiment, it is intended that approximately the number is disclosed for an embodiment and that substantially the number is disclosed for an embodiment. For example, if the specification discloses an embodiment comprising a dimension of 1.0 millimeter, it will be understood that a disclosed embodiment comprises a dimension of approximately 1.0 millimeter and that a disclosed embodiment comprises a dimension of substantially 1.0 millimeter.

In each instance in which a range of numbers is disclosed for an embodiment, it is intended that approximately the range of numbers is disclosed for an embodiment and that substantially the range of numbers is disclosed for an embodiment. For example if the specification discloses an embodiment comprising a dimension in a range of 1.0 to 2.0 millimeters, it will be understood that a disclosed embodiment comprises a dimension in an approximate range of 1.0 to 2.0 millimeters. Further, in this example, a disclosed embodiment comprises a dimension in a range of approximately 1.0 millimeter to approximately 2.0 millimeters. Further, in this example, a disclosed embodiment comprises a dimension in a substantial range of 1.0 to 2.0 millimeters. Further, in this example, a disclosed embodiment comprises a dimension in a range of substantially 1.0 millimeter to substantially 2.0 millimeters.

As will be appreciated by those of skill in the art, unless clearly specified otherwise, the values provided herein intend to reflect commercial design practices or nominal manufacturing targets. For example, what may be described or specified as having a dimension of one millimeter or 1.0 mm, may deviate from one millimeter or 1.0 mm when implemented in a commercial product due to fabrication error, warpage, or customary tolerances.

The term "net game," as used herein, generally refers to a game in which opposing players volley an object back and forth over a net. Pickleball, tennis, volleyball, and badminton are examples of net games.

The term "piezochromic coating," as used herein, generally refers to a coating having an optical property that undergoes a change in response to at least one macroscopic mechanical stimulus, wherein the coating remains intact, and wherein the change is visible to unaided eyes of a human having normal vision. The optical property can comprise color, for example. The stimulus can comprise pressure, shock, shear, or impact, for example. A piezochromic coating can comprise mechanochromic material. A piezochromic coating can comprise a mechanochromic coating. A piezochromic coating can comprise mechanochromic luminescence material. A piezochromic coating can comprise a mechanochromic luminescence coating. A piezochromic coating can comprise mechanofluorochromic material. A piezochromic coating can comprise a mechanofluorochromic coating. A piezochromic coating can comprise mechano-phosphorescent material. A piezochromic coating can comprise a mechano-phosphorescent coating.

The term "piezochromic threshold," as used herein, generally refers to a threshold level of macroscopic mechanical stimulus that causes a piezochromic coating to undergo the change. The term "reversible piezochromic coating," as used herein, generally refers to a piezochromic coating in which the change is reversible. The term "irreversible piezochromic coating," as used herein, generally refers to a piezochromic coating in which the change is irreversible.

The term "non-piezochromic coating," as used herein, generally refers to a coating other than a piezochromic coating.

The term "piezochromic material," as used herein, generally refers to a material having an optical property that undergoes a change in response to at least one macroscopic mechanical stimulus, wherein the material remains intact, and wherein the change is visible to unaided eyes of a human having normal vision. The stimulus can comprise pressure, shock, shear, or impact, for example. The optical property can comprise color, for example.

The term "color," as used herein, generally refers to a property of an object that an average person visually perceives when light interacts with the object and enters the person's eyes and that enables the person to differentiate otherwise identical objects without aid of instrumentation. The term "color" can thus be read with a plain and ordinary meaning.

The term "color change," as used herein, generally refers to a change in color that an average person can perceive without aid of instrumentation. The term "color change" can thus be read with a plain and ordinary meaning.

The written description (comprising text and figures) of the present patent application includes content that is incorporated by reference and content that has not been incorporated by reference (i.e., content that is written directly into the specification and figures as originally filed at the U.S. Patent Office). In the event that inconsistency exists between the incorporated-by-reference content and the not-incorporated-by-reference content with respect to usage, interpretation, meaning, definition, or construction of a term, then the not-incorporated-by-reference content shall dictate usage, interpretation, meaning, definition, or construction of the term. Thus, to the extent that disclosure incorporated by reference uses a first meaning for a term that differs materially from a second meaning for the term that is used herein without the disclosure incorporated by reference, then the term should be interpreted under the second meaning.

The entire contents of U.S. Provisional Patent Application No. 63/506,364, including the appended documents that form the Appendix of U.S. Provisional Patent Application No. 63/506,364, are hereby incorporated herein by reference.

Turning now to the Figures, some illustrated embodiments will be discussed in turn.

FIGS. 1A, 1B, 1C, 1D, 1E, and 1F illustrate an example system 100 for marking a pickleball bounce point 10 during pickleball play according to some embodiments of the disclosure. FIG. 1A illustrates a pickleball court 20 that is configured to provide a mark 25 at a bounce point 10 where a pickleball 50 strikes the court 20 during play or during a pickleball game. The mark 25 provides a visible indication of whether the bounce point 10 was in an in-bounds area 30 of the pickleball court 20, which includes the line 35, or an out-of-bounds area 40 of the pickleball court 20. The mark 25 can help players and/or line judges and/or referees (and/or other people) determine whether the pickleball 50 was in-bounds or out-of-bounds, and thus which player prevailed in a volley or won a point. The mark 25 can be decisive or conclusive for awarding a point in some embodiments.

In some example embodiments, the pickleball court 20 is an indoor court with a relatively controlled environment. In some example embodiments, the pickleball court 20 is an outdoor court that is subject to outdoor environmental conditions.

Figure 1B:
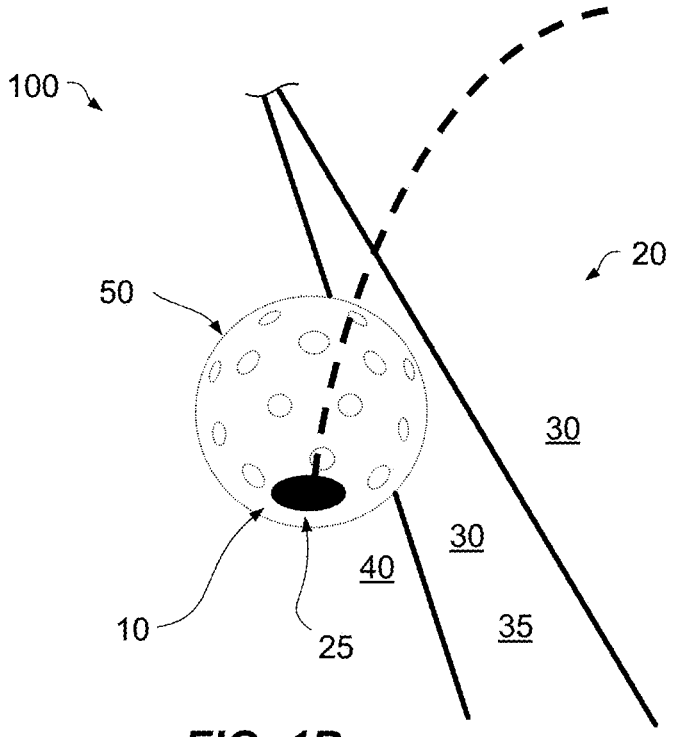
Figure 1C:
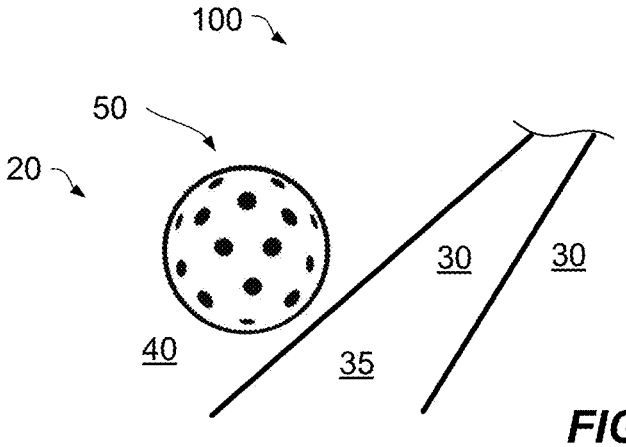
Figure 1D:
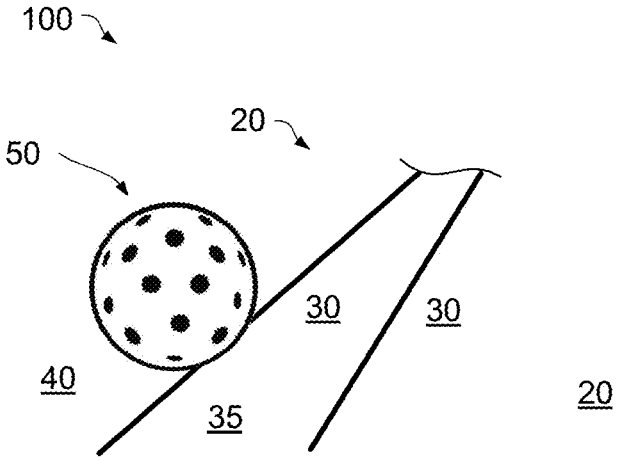

As illustrated by FIGS. 1B, 1C, and 1D, players, referees, and line judges are typically looking down at the pickleball 50 and the pickleball court 20 when the pickleball 50 strikes and bounces from the court 20. As best illustrated by FIG. 1 D, from their vantage, the pickleball 50 can cover or obscure the line 35 when the bounce point 10 is near the line 35. Without benefit of the mark 25, players, referees, and line judges may thus not be able to reliably conclude whether the pickleball 50 is in-bounds or out-of-bounds.

In the illustrated example scenario of FIG. 1B, the mark 25 indicates that the bounce point 10 is off the line 35 on the out-of-bounds side of the line 35. Therefore, the mark 25 shows that the pickleball 50 was out-of-bounds when players, referees, or line judges may not have been able to reliably ascertain location of the bounce point 10 without benefit of the mark 25.

In the illustrated example scenario of FIG. 1C, the pickleball 50 is well in the out-of-bounds area 40 when the pickleball 50 contacts the surface of the pickleball court 20. In this situation, players, referees, or line judges may be able to call the pickleball 50 clearly out-of-bounds with or without benefit of the mark 25. As further discussed below with reference to FIGS. 1E and 1F, the pickleball court 20 can thus comprise one or more areas (see reference number 40*b*) that support making acceptably reliable in-bounds and out-of-bounds judgements without benefit of the mark 25.

In the illustrated example scenario of FIG. 1D, without benefit of the mark 25, the pickleball 50 appears to touch the line 35 and thus to be in-bounds as observed by players, referees, or line judges. However, with benefit of the mark 25 as illustrated by FIG. 1B, players, referees, and line judges can see that the pickleball 50 is clearly out-of-bounds. As further discussed below with reference to FIGS. 1E and 1F, the pickleball court 20 can thus comprise one or more areas (see reference number 40*a*) proximate to the line 35 in which the pickleball 50 obscures the line 35 during contact with the pickleball court 20, thereby obstructing acceptably reliable in-bounds and out-of-bounds judgements without benefit of the mark 25.

Figure 1E:
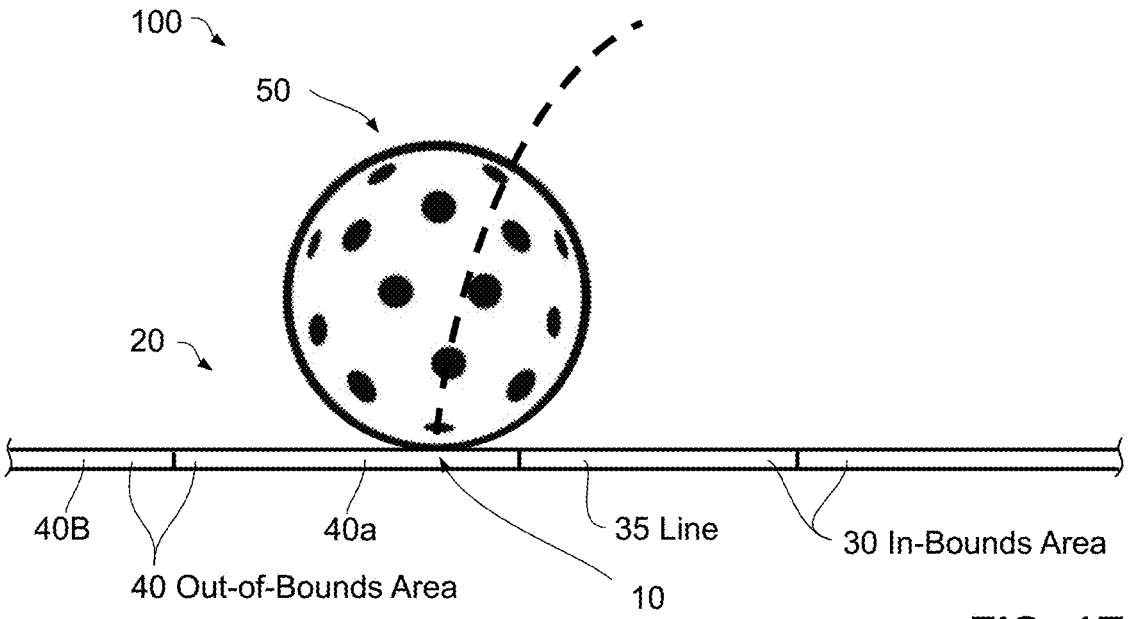
Figure 1F:
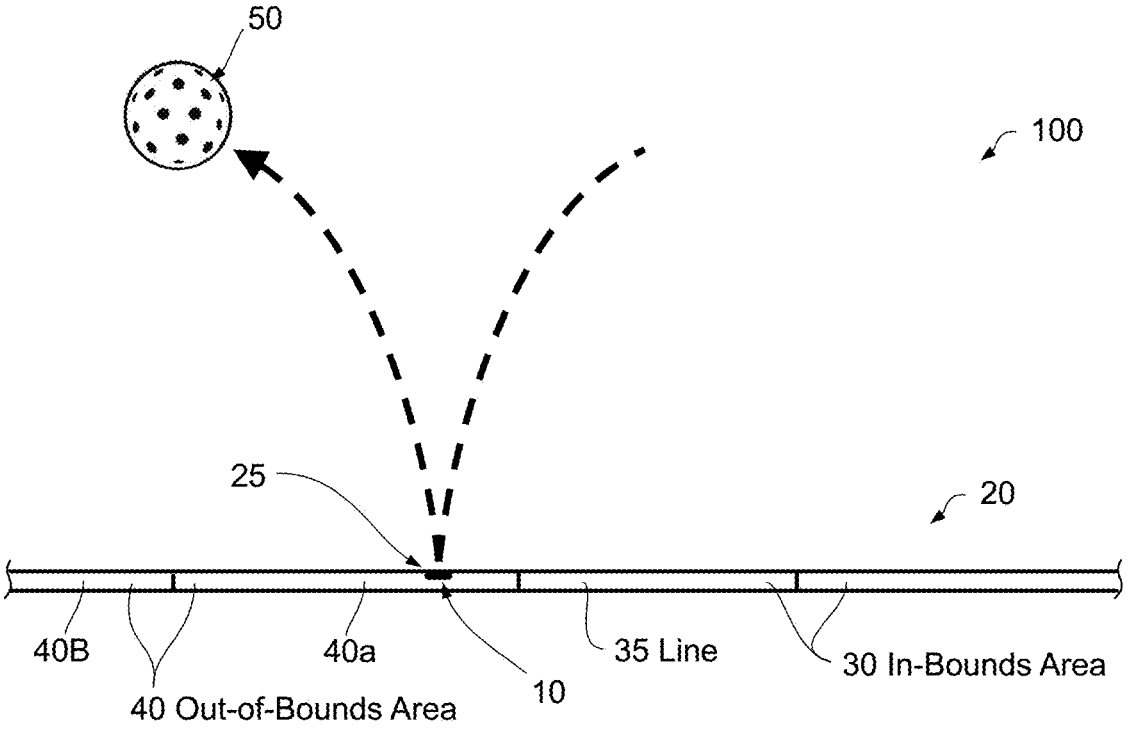

Referring now to FIGS. 1E and 1F, these figures further illustrate, in representative side view, an example scenario in which the mark 25 can resolve whether a bounce point 10 is in-bounds or out-of-bounds. As illustrated by FIGS. 1E and 1F, the out-of-bounds area 40 comprises two subareas 40*a*, 40*b*.

The subarea 40*b* comprises an area of the pickleball court 20 in which players, referees, or line judges generally can, with acceptable reliability, call the pickleball 50 in-bounds or out-of-bounds without benefit of the mark 25. The subarea 40*b* thus corresponds to the scenario discussed above with reference to FIG. 1C.

The subarea 40*a* comprises an area of the pickleball court 20 that is disposed adjacent the line 35 and between the subarea 40*b* and the line 35. The subarea 40*a* comprises an area in which the pickleball 50 obscures at least a portion of the line 35 during contact with the court 20 from a perspective of a player or from a perspective of a player, referee, or line judge.

The pickleball 50 is relatively incompressible as compared to a tennis ball (not illustrated). When a tennis ball strikes and bounces from a tennis ball court (not illustrated), the tennis ball typically compresses, deforms, and spreads as the ball bounces from the tennis ball court. Contact between the tennis ball and the tennis court thus often occurs over a relatively large area on the surface of the tennis ball. A bounce point of a tennis ball on a tennis ball court can be a generally-circular area with a diameter that is similar to the diameter of the tennis ball in a relaxed state.

In comparison to tennis, when the pickleball 50 strikes and bounces from the pickleball court 20, as illustrated in FIG. 1E, the pickleball 50 contacts the court 20 at the bounce point 10 in a relatively small area due to the pickleball's relative incompressibility. The bounce point 10 of the pickleball 50 is a generally-circular area that is much smaller diametrically than the diameter of the pickleball 50 in a relaxed state. As illustrated by FIG. 1E, the size of the pickleball 50 therefore often obscures the bounce point 10 of the pickleball 50 during pickleball play.

Accordingly, without benefit of the mark 25 illustrated in FIG. 1F, visibly judging whether a pickleball 50 is in-bounds or out-of-bounds can be substantially more challenging and controversial than judging whether a tennis ball is in-bounds or out-of-bounds. (Nevertheless, conventionally judging whether a tennis ball is in-bounds or out-of-bounds can often be challenging and controversial.)

Thus, as shown in FIGS. 1A, 1B, 1C, 1D, 1E, and 1F, the capability of the illustrated pickleball court 20 to mark the bounce point 10 helps players, referees, and line judges determine whether the pickleball 50 bounced in-bounds or out-of-bounds.

Figure 2:
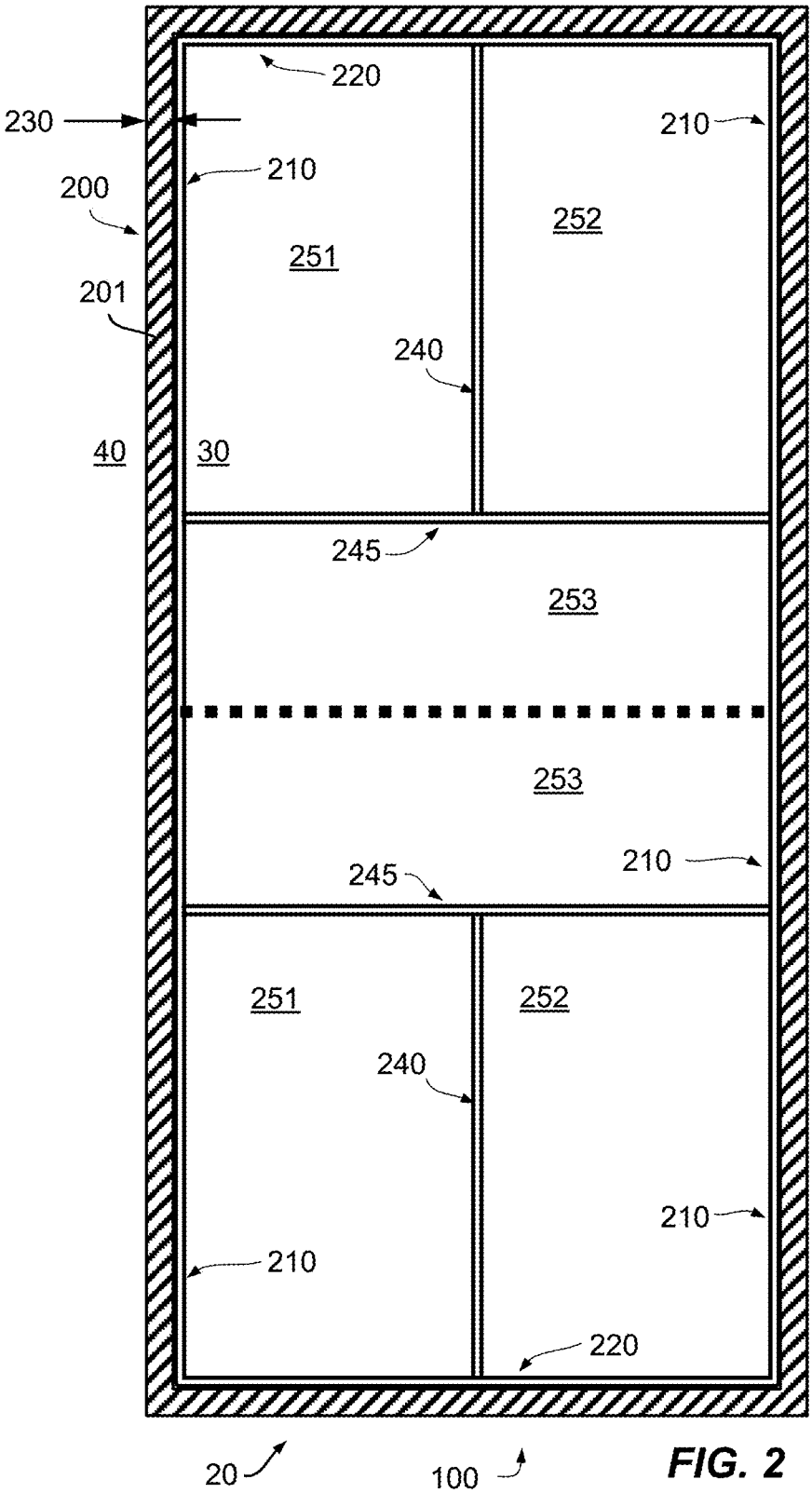
FIG. 2 is an illustration of a pickleball court configured to mark a pickleball bounce point during pickleball play in accordance with some example embodiments of the disclosure.

Turning now to FIG. 2, this figure illustrates an example pickleball court 20 configured to mark a pickleball bounce point 10 during pickleball play according to some embodiments of the disclosure. As illustrated, the court 20 comprises an example embodiment of a system 100 for marking the pickleball bounce point 10 during pickleball play as discussed above with reference to FIG. 1. As further discussed below, FIG. 2 illustrates an example embodiment in which one or more selected areas 201 of the pickleball court 20 have been configured to mark a pickleball bounce point 10 by applying a piezochromic coating 200 to the one or more selected areas 201 of the pickleball court 20.

In the illustrated example of FIG. 2, the piezochromic coating 200 has been applied to form the coated area 201 in the out-of-bounds area 40 of the pickleball court 20. The example coated area 201 comprises a strip extending about the pickleball court 20 adjacent side lines 210 and base line 220 of the court 20, on the out-of-bounds side of the side and base lines 210, 220. The side and base lines 210, 220 comprise an example embodiment of the line 35 illustrated in FIG. 1 as discussed above.

As illustrated by FIG. 2, the coated area 201 forms a perimeter around the in-bounds area 30 of the pickleball court 20. In some embodiments, the coated area 201 adjoins the in-bounds area 30. In some embodiments, the coated area 201 adjoins the lines 210, 220. In some embodiments, the coated area 201 contacts the lines 210, 220. In some example embodiments, the coated area 201 can have a width 230 in a range of 3 to 15 centimeters. In some example embodiments, the coated area 201 can have a width 230 not greater than 20 centimeters.

In some example embodiments, the coated area 201 extends width-wise from an outer edge of the line 210, 220 to a location in the out-of-bounds area 40 where a player, referee, or line judge can locate a pickleball bounce point 10 with acceptable reliability without benefit of the mark 25. In some example embodiments, the coated area 201 can thus comprise the subarea 40*a* that FIGS. 1E and 1F illustrate as discussed above. Accordingly, the subarea 40*a* can be selectively coated with piezochromic coating 200 to form the coated area 201 as illustrated by FIG. 2.

In the illustrated embodiment of FIG. 2, if the pickleball 50 bounces near the line 210, 220 without leaving a visible mark 25 (see the mark 25 in FIGS. 1A, 1B, and 1F), players, referees, and line judges can conclude that the pickleball 50 was in-bounds. Thus, absence of the mark 25 can support an in-bounds call.

In some example embodiments (not illustrated by FIG. 2), the piezochromic coating 200 extends over the entire court.

In some example embodiments (not illustrated by FIG. 2), the pickleball court 20 comprises one or more selected areas of the piezochromic coating 200 extending along centerlines 240 of the court 20. So configured, the pickleball court 20 can be operable for marking whether a pickleball bounce point 10 is in a right service area 251 or a left service area 252 of the court 20.

In some example embodiments (not illustrated by FIG. 2), the pickleball court 20 comprises one or more selected areas of the piezochromic coating 200 extending along non-volley lines 245 of the court 20. So configured, the pickleball court 20 can be operable for marking whether a pickleball bounce point 10 is in a non-volley zone 253 of the court 20.

In some example embodiments, the piezochromic coating 200 is limited to the in-bounds area 30 of the court, or a portion thereof. In such embodiments, if the pickleball 50 bounces near the side or base lines 210, 220 without leaving a mark 25 (see the mark 25 in FIGS. 1A, 1B, and 1F), players can conclude that the pickleball 50 was out-of-bounds. Thus, absence of the mark 25 can support an out-of-bounds call or ruling.

In some example embodiments, the piezochromic coating 200 may be limited to the side and base lines 210, 220, so that the coated area 201 overlays and matches the lines 210, 220. In some example embodiments, the side and base lines 210, 220 comprise the piezochromic coating 200. For instance, the lines 210, 220 can be painted onto the pickleball court 20 with a paint that comprises piezochromic material and that comprises the piezochromic coating 200. One or more of the side lines 210, the base lines 220 the centerlines 240, and the non-volley lines 245 can comprise the piezochromic coating 200.

Figure 3:
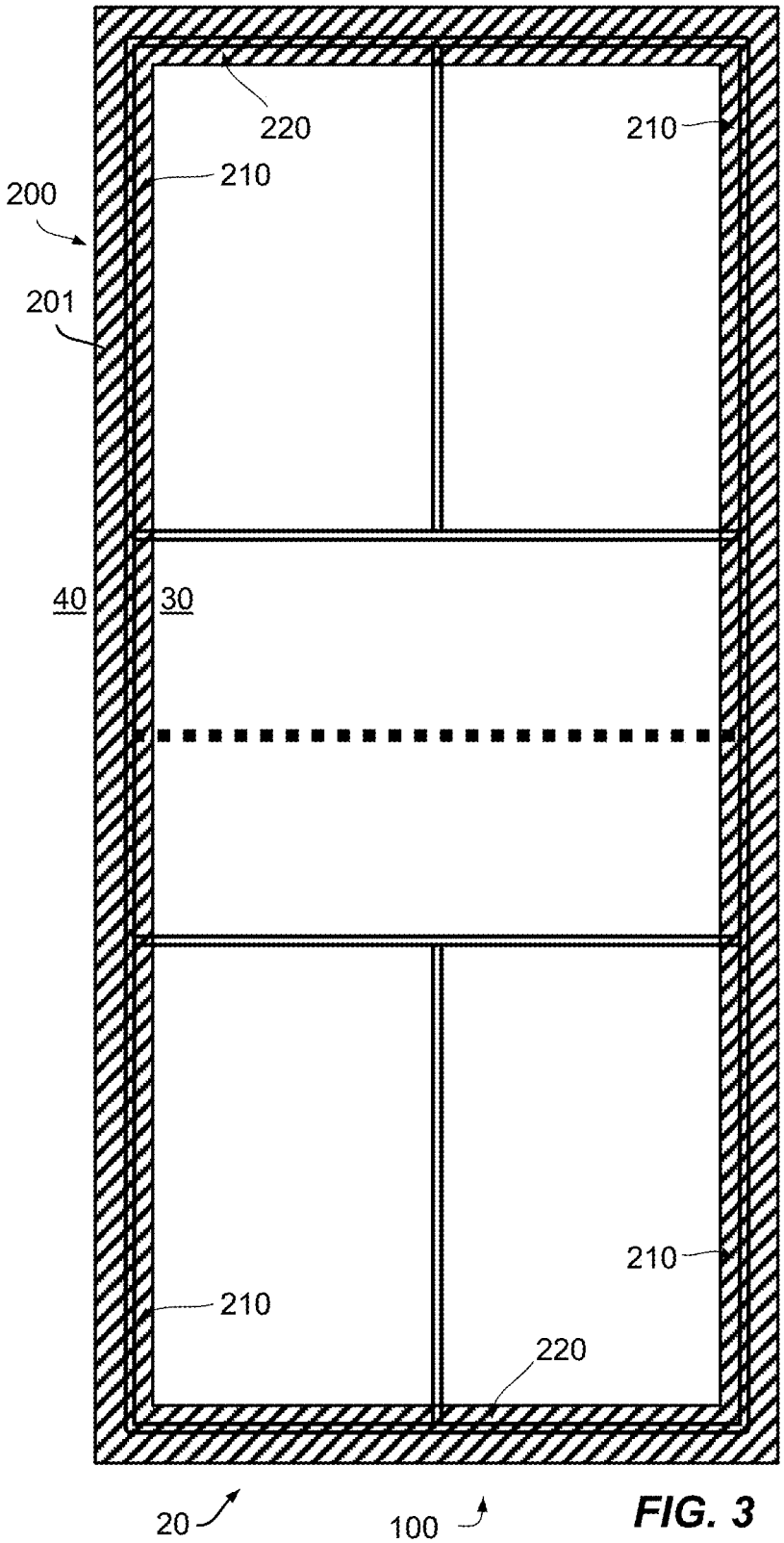
FIG. 3 is an illustration of a pickleball court configured to mark a pickleball bounce point during pickleball play in accordance with some example embodiments of the disclosure.

Turning now to FIG. 3, this figure illustrates an example pickleball court 20 configured to mark a pickleball bounce point 10 during pickleball play according to some embodiments of the disclosure. As illustrated, the court 20 comprises an example embodiment of a system 100 for marking a pickleball bounce point 10 during pickleball play as discussed above with reference to FIG. 1. As further discussed below, FIG. 3 illustrates an example embodiment in which one or more selected areas 201 of the pickleball court 20 have been configured to mark a pickleball bounce point 10 by applying a piezochromic coating 200 to the one or more selected areas 201 of the pickleball court 20.

In the illustrated embodiment of FIG. 3, the piezochromic coating 200 has been applied to form the coated area 201 of the pickleball court 20. The example coated area 201 comprises a strip extending about the pickleball court 20 and encompassing the side lines 210 and base lines 220 of the court 20. As illustrated, the coated area 201 further extends along the side lines 210 and base lines 220, both on the out-of-bounds side and on the in-bounds side of the side and base lines 210, 220. The example piezochromic coating 200 of FIG. 3 covers the lines 210, a strip of the in-bounds area 30 adjoining the lines, 210, 220, and a strip of the out-of-bounds area 40 adjoining the lines 210, 220.

Figure 4A:
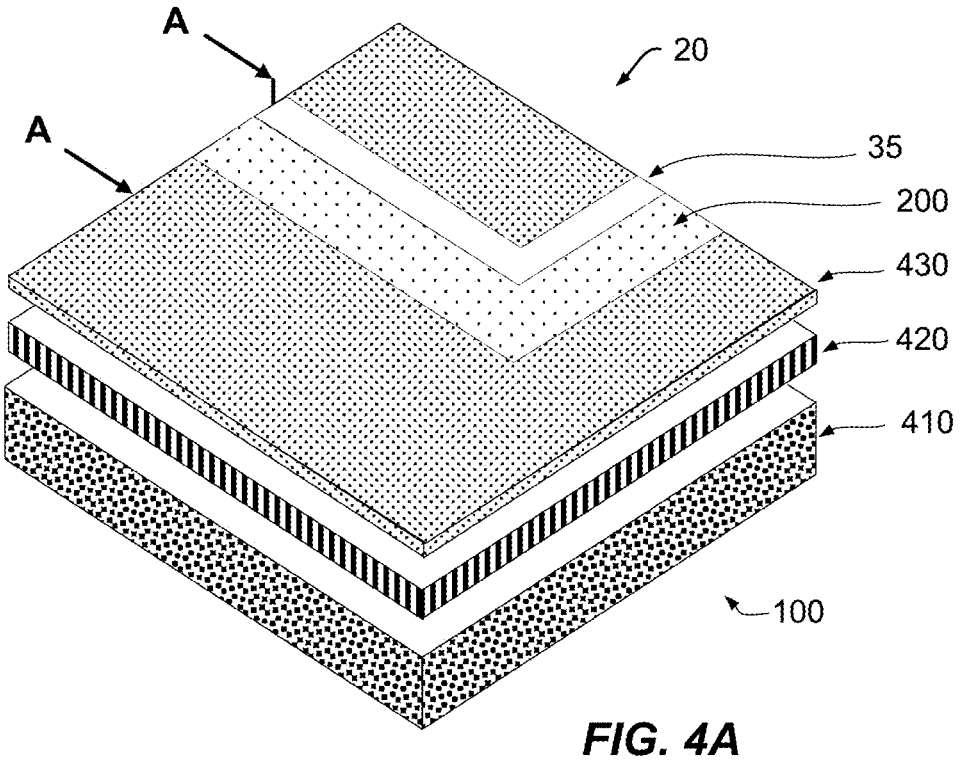
FIGS. 4A and 4B (collectively FIG. 4) are cross sectional illustrations of a pickleball court configured to mark a bounce point during pickleball play in accordance with some example embodiments of the disclosure.
Figure 4B:
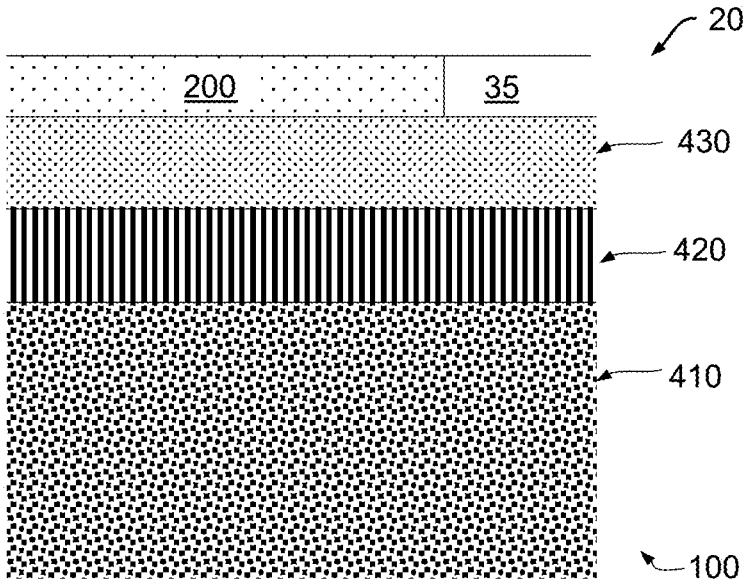

Turning now to FIGS. 4A and 4B, these figures illustrate cross sectional views of an example pickleball court 20 configured to mark a bounce point 10 during pickleball play according to some embodiments of the disclosure. As illustrated, the court 20 comprises an example embodiment of a system 100 for marking the pickleball bounce point 10 during pickleball play as discussed above with reference to FIG. 1. FIG. 4 illustrates exaggerated material thicknesses to promote reader visibility of the illustrated example layers.

The example pickleball court 20 that FIG. 4 illustrates comprises a foundation 410, a cushion layer 420, a color coating 430, a piezochromic coating 200, and a line 35. The foundation 410 can comprise concrete, asphalt, or other suitable structural material in some example embodiments. In some example embodiments, the cushion layer 420 can comprise a synthetic material with sufficient give to mitigate injury risk for players and/or to promote comfortable play, for instance a blend of elastomeric and rigid materials. In some example embodiments, the color coating 430 can comprise a colored acrylic material. As illustrated, the color coating comprises a non-piezochromic coating. In some example embodiments, the line 35 can comprise white paint.

In the illustrated example of FIG. 4, the piezochromic coating 200 adjoins the line 35 on the out-of-bounds side of the line 35. As illustrated, the piezochromic coating 200 is applied on top of the color coating 430. In some example embodiments, the piezochromic coating 200 has a color that matches or substantially matches the color of the color coating 430 immediately below the piczochromic coating 200. Thus, the piezochromic coating 200 and the color coating 430 can have a common color (with the piezochromic coating 200 in an unmarked state). In some example embodiments, the piezochromic coating 200 is transparent or clear in the unmarked state. Some example embodiments of the piezochromic coating 200 will be further discussed below.

In some example embodiments (not illustrated by FIG. 4), the color coating 430 contains embedded piezochromic material. Accordingly, the color coating 430 can comprise a piezochromic coating 200 in some embodiments. Moreover, in some example embodiments, the line 35 can comprise embedded piezochromic material. Accordingly, the line 35 can comprise a piczochromic coating 200 in some embodiments.

Figure 5:
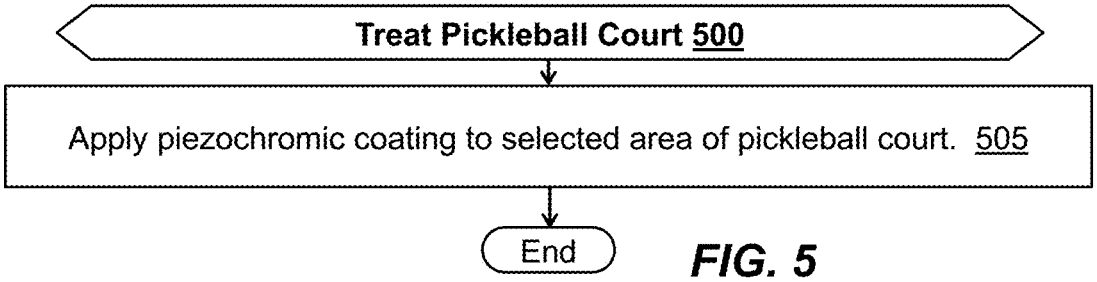
FIG. 5 is flowchart of a process for treating a pickleball court in accordance with some example embodiments of the disclosure.

Turning now to FIG. 5, this figure illustrates a representative flowchart of an example process 500 for treating a pickleball court 20 according to some embodiments of the disclosure. Treating a pickleball court 20 according to FIG. 5 comprises an exemplary embodiment of producing a system 100 for marking the pickleball bounce point 10 during pickleball play as discussed above with reference to FIG. 1.

At block 505 of the process 500, a piezochromic coating 200 is applied to a selected area of the pickleball court 20 and adheres to the court 20. The selected area can comprise the coated area 201 illustrated in FIG. 2 or FIG. 3 or another specified area of the pickleball court 20 at which a capability for marking pickleball bounce points 10 is desired or deemed beneficial. As discussed above, in some example embodiments, the piezochromic coating 200 can be applied over the line 35, as the line 35, on an in-bounds side of the line 35, or on an out-of-bounds side of the line 35. In some embodiments, the piezochromic coating 200 is applied to cover and adhere to the entire pickleball court 20.

In some example embodiments, a clear, non-piezochromic coating is applied over the piezochromic coating 200 for protection against wear or abrasion or for protection via attenuating ultraviolet components of sunlight that could degrade the piezochromic coating 200. Thus, a lower surface of the clear non-piezochromic coating can adhere to an upper surface of the piezochromic coating 200, which adheres, in turn, to a surface of the pickleball court 20.

In some example embodiments, the piezochromic coating 200 can comprise particles of one or more materials that provide the piezochromic coating 200 with specified mechanical properties. In some example embodiments, the piezochromic coating 200 can comprise particles of silica such that the coating 200 composes silica in a range of 2 to 10 percent by weight. In some example embodiments, the piezochromic coating 200 can comprise granules or particles of elastomeric material such that the coating 200 composes elastomeric material in a range of 2 to 10 percent by weight. Accordingly, as further discussed below, mechanical properties of coated and uncoated portions of the pickleball court 20 can be favorably controlled to facilitate uniform play across the court 20.

In some example embodiments further supported by the examples discussed below, the piczochromic coating 200 forms a first exterior surface of the pickleball court 20; a non-piezochromic coating forms a second exterior surface of the pickleball court 20 that is disposed laterally adjacent the first exterior surface of the pickleball court 20; the first exterior surface has a first Young's modulus; and the second exterior surface has a second Young's modulus that is within ten percent of the first Young's modulus. The pickleball court 20 can thus comprise an exterior coating that is non-piezochromic and another exterior coating that is piczochromic. The piczochromic coating and the non-piezochromic coatings can have distinct values of Young's modules. The value of Young's modulus of the non-piezochromic coating can be within ten percent of the value of Young's modulus of the piezochromic coating.

In some example embodiments further supported by the examples discussed below, the piezochromic coating 200 forms a first exterior surface of the pickleball court 20; a non-piezochromic coating forms a second exterior surface of the pickleball court 20 that is disposed laterally adjacent the first exterior surface of the pickleball court 20; the first exterior surface has a first indentation hardness on a scale; the second exterior surface has a second indentation hardness on the scale; the first indentation hardness is within ten percent of the second indentation hardness, and the scale comprises the Rockwell indentation scale, the Vickers indentation scale, the Shore indentation scale, or the Brinell indentation scale.

In some example embodiments further supported by the examples discussed below, the piczochromic coating 200 forms a first exterior surface of the pickleball court 20; a non-piezochromic coating forms a second exterior surface of the pickleball court 20 that is disposed laterally adjacent the first exterior surface of the pickleball court; the first exterior surface has a first Leeb rebound hardness; the second exterior surface has a second Leeb rebound hardness; and the first Leeb rebound hardness is within ten percent of the second Leeb rebound hardness.

In some example embodiments further supported by the examples discussed below, the piezochromic coating 200 forms a first exterior surface of the pickleball court 20; wherein a non-piezochromic coating forms a second exterior surface of the pickleball court 20 that is disposed laterally adjacent the first exterior surface of the pickleball court 20; the first exterior surface has a first rebound hardness on the Bennett hardness scale; the second exterior surface has a second rebound hardness on the Bennett hardness scale; and the first rebound hardness is within ten percent of the second rebound hardness.

In some example embodiments further supported by the examples discussed below, a non-piezochromic coating forms a first exterior surface of the pickleball court 20; the piezochromic coating 200 forms a second exterior surface of the pickleball court 20 that is disposed laterally adjacent the first exterior surface of the pickleball court 20; the first exterior surface has a first kinetic friction coefficient with a pickleball 50 that conforms to the Standards of the International Federation of Pickleball as set forth in the USA Pickleball 2021 Equipment Standards Manual; the second exterior surface has a second kinetic friction coefficient with the pickleball 50; and the first kinetic friction coefficient is within ten percent of the second kinetic friction coefficient. The pickleball court 20 can thus comprise an exterior coating that is non-piezochromic and another exterior coating that is piezochromic. The piezochromic coating and the non-piezochromic coating can have distinct kinetic friction coefficients. The kinetic friction coefficient of the non-piezochromic coating can be within ten percent of the kinetic friction coefficient of the piezochromic coating.

In some example embodiments further supported by the examples discussed below, a non-piezochromic coating forms a first exterior surface of the pickleball court 20; the piezochromic coating 200 forms a second exterior surface of the pickleball court 20 that is disposed laterally adjacent the first exterior surface of the pickleball court 20; the first exterior surface has a first average roughness (a first Ra); the second exterior surface has a second average roughness (a second Ra); and the first Ra is within ten percent of the second Ra.

Figure 6:
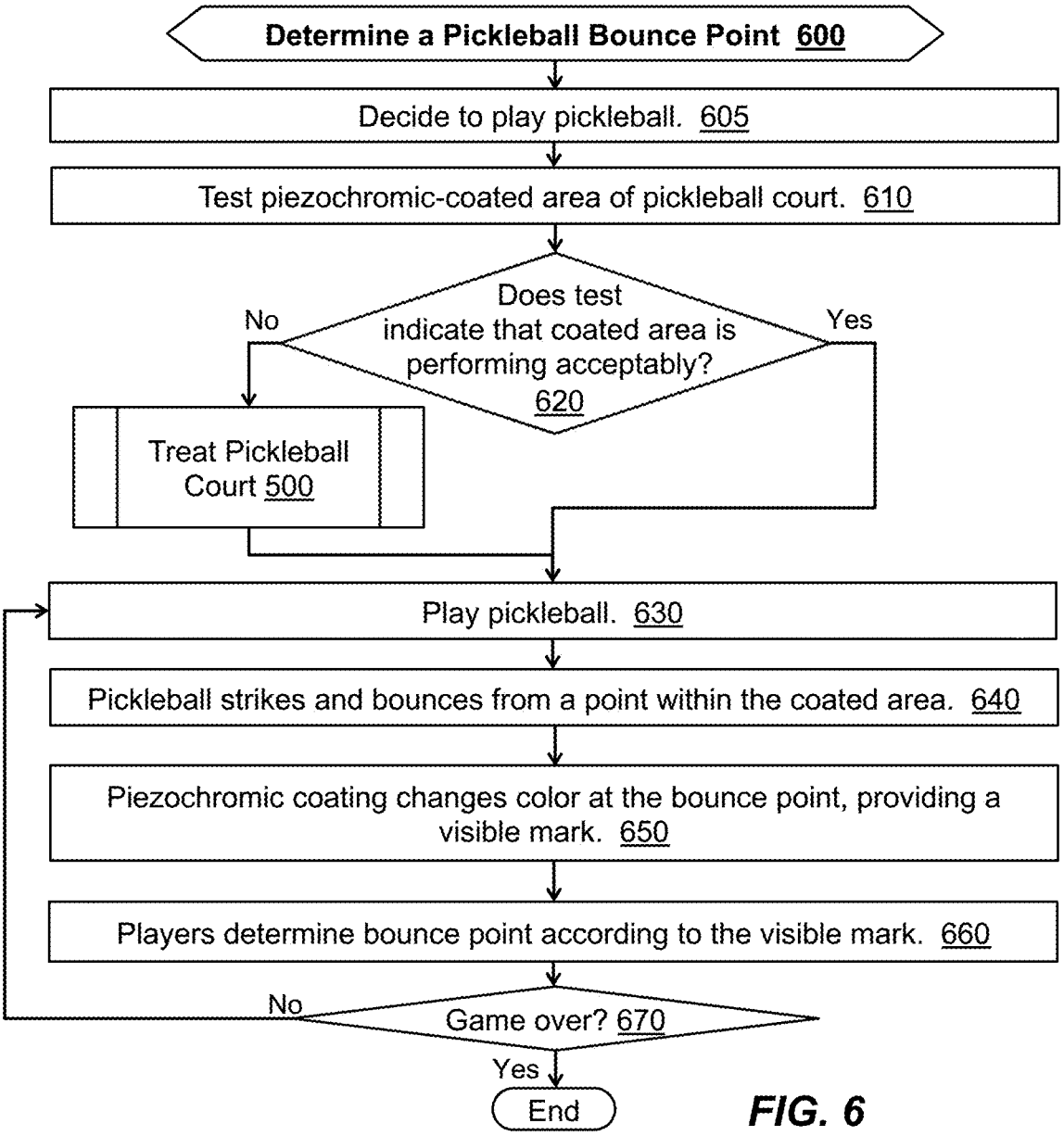
FIG. 6 is flowchart of a process for determining a pickleball bounce point during pickleball play in accordance with some example embodiments of the disclosure.

Turning now to FIG. 6, this figure illustrates a representative flowchart of an example process 600 for determining a pickleball bounce point 10 according to some embodiments of the disclosure. In some example embodiments, the process 600 can be practiced with support from the system 100 for marking the pickleball bounce point 10 during pickleball play as discussed above.

At block 605 of the process 600, a decision is made to play pickleball. For instance, two casual players may decide to oppose one another in a friendly game of pickleball.

At block 610, an area 201 of the pickleball court 20 that is coated with piezochromic coating 200 is tested to evaluate whether the piezochromic coating 200 can acceptably mark pickleball bounce points 10. For instance, the players may bounce a pickleball 50 off of the court 20 and observe whether the bounce created a visible mark 25 suitable for calling balls in-bounds or out-of-bounds.

At decision block 620, if the test indicates that the coated area 201 does not perform acceptably, then the process 600 branches to block 500. At block 500, the process 600 calls the process 500, and coated area 201 of the pickleball court 20 is re-coated with the piczochromic coating 200. In some example embodiments, the players roll, brush, or spray a fresh coat of the piezochromic coating 200 in one or more selected areas of the pickleball court. For instance, in some example embodiments, the players may only apply the piezochromic coating 200 where they believe fresh coating is needed or will be beneficial.

In some example embodiments, the players may heat the piezochromic coating 200 rather than recoating the court 20. For example, the players may utilize a heated roller, a heat gun, or a heat lamp to heat locations on the coated area 201 they want to heat-treat to refresh the marking capabilities of the coated areas 201 of the pickleball court 20. In some example embodiments, the heat treatment can promote or cause reversal of marks 25 that are pre-existing as a result of one or more prior games played by other players on the court 20.

In some example embodiments, the piezochromic coating 200 is an irreversible piezochromic coating, and the coated area 201 of the court 20 exhibits marks 25 from prior play. The players may, for example, use an aerosol spray can to cover those pre-existing marks individually with fresh piezochromic coating 200. In some example embodiments, the sprayed piezochromic coating cures by application of ultraviolet (UV) light, and the players use a handheld UV light (not illustrated) to cure each spot they have sprayed.

If the decision at block 620 is positive rather than negative, then the process 600 executes block 630 instead of block 500. At block 630, the players play a game of pickleball. At block 640, the pickleball 50 strikes the piezochromic coating 200 and bounces. At block 650, the piezochromic coating 200 undergoes a color change at the bounce point 10, resulting in a mark 25 at the bounce point 10.

At block 660, the players view the mark 25 to determine whether the pickleball 50 was in-bounds or out-of-bounds upon striking the pickleball court 20. In some example embodiments, the mark 25 is visible in sunlight. In some example embodiments, the mark 25 is visible under artificial lighting, for instance light emitted by overhead lights that illuminate the court 20 after dark or during nighttime play. In some example embodiments, the mark 25 responds to UV light, and the players may shine a handheld UV source at an area of the court 20 where a disputed bounce has occurred, whereby the UV source illuminates the mark 25. In some embodiments, the illuminating UV light increases visibility of the mark 25. In some example embodiments, the mark 25 is only visible under the illuminating UV light. In some example embodiments, the players occlude sunlight or overhead artificial light from the disputed area of the court while illuminating the area with a UV light from a handheld source.

At decision block 670, if the game is not over, then the process 600 loops back to block 630 and play continues. If the game is over, then the process 600 ends following decision block 670.

Some example embodiments of the piezochromic coating 200 will now be discussed.

Examples 1-4

In some example embodiments, those of ordinary skill in the art having benefit of the teaching provided herein can practice the piezochromic coating 200 utilizing the teaching provided herein and their ordinary skill in combination with disclosure present in US Patent Application Publication Number 2007/0259286, entitled "Reversible Piezochromic Systems," published Nov. 8, 2007, and naming Nathalie Leroux as inventor (hereinafter "the '286 Application"), the entire contents of which are hereby incorporated herein by reference.

Example 1

In some examples, the piezochromic coating 200 can be practiced utilizing disclosure of the '286 Application comprising the disclosure of paragraphs and headed "EXAMPLE 1." Accordingly, a piczochromic powder 710 can be formulated by mixing 20 parts of 3-(2,2-bis(1-ethyl-2-methylindol-3-yl) vinyl)-3-(4-diethylaminophenyl)-phthalide in a powder state with 80 parts of undecanoic acid in a powder state at around 18 degrees C.

In some example embodiments, the piezochromic powder 710 is dissolved in a fatty acid. Additionally, the resulting piezochromic fluid can be mixed into a clear coat, such as linseed oil or un-tinted polyurethane finish.

3-(2,2-bis(1-ethyl-2-methylindol-3-yl) vinyl)-3-(4-dicthylaminophenyl)-phthalide, CAS Number 565457-61-6, is commercially available from BOC Sciences/BOCSCI Inc. of Shirley, New York., having a phone number of 631-504-6093, under Catalog Number BB044145.

Undecanoic acid, CAS Number 112-37-8, is commercially available from BOC Sciences/BOCSI Inc. under Catalog Number 112-37-8.

Figure 7:
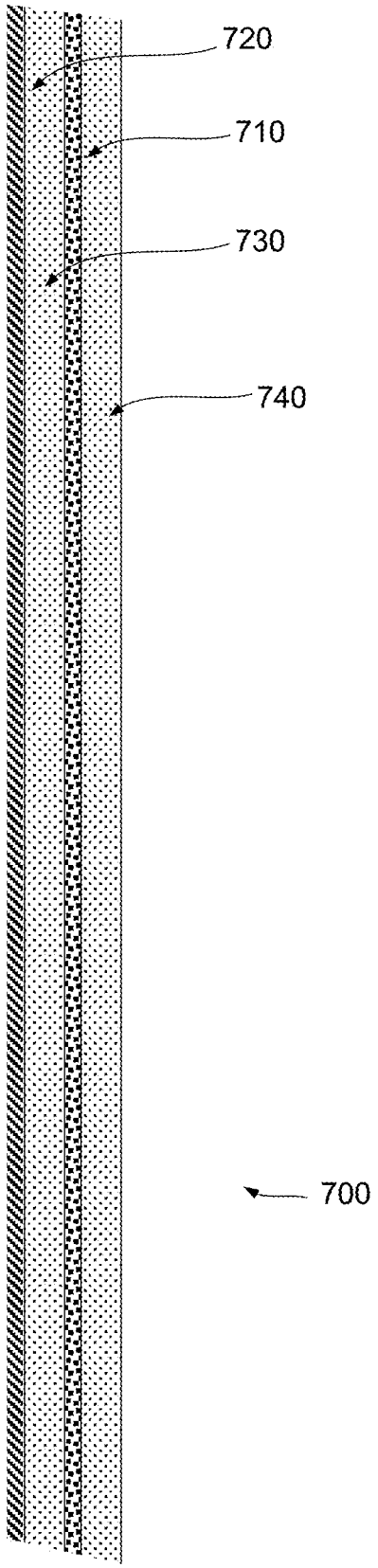
FIG. 7 is a cross sectional illustration of a tape for application to a pickleball court to mark a pickleball bounce point during pickleball play in accordance with some example embodiments of the disclosure.

A piezochromic tape 700 can comprise the piezochromic power 710, an upper tape 740, a lower tape 730, and an adhesive 720 for adhering to the pickleball court 20. FIG. 7 illustrates, in a cross sectional view, an example embodiment of the piezochromic tape 700, wherein the piezochromic powder 710 is fixed or laminated between the upper and lower tapes 740, 730. In the illustrated embodiment, the upper tape 740 can comprise a clear, transparent, or translucent material, for instance polyvinyl chloride (PVC), polypropylene, or another appropriate polymeric material. In some example embodiments, the upper tape 740 comprises a woven or nonwoven fabric that can comprise fiberglass, rayon fibers, polyethylene terephthalate (PET) fibers, or polypropylene fibers, to provide some representative examples without limitation. The lower tape 730 can comprise a like material to the upper tape 740 or may be composed of an opaque material that may be colored to match a surface of the pickleball court 20 to which the tape 700 adheres, for example.

As illustrated by FIG. 7, the piezochromic tape 700 comprises an example embodiment of the piezochromic coating 200. In some example embodiments, the tape has a width in a range of 3 to 15 centimeters that corresponds to width of a strip of pickleball court 20 to be coated as discussed above with example reference to FIGS. 2 and 3. The piezochromic tape 700 can be applied to the pickleball court 200 to extend alongside the line 35 that FIG. 1 illustrates (or the corresponding lines 210, 220, 240, 245 that FIGS. 2 and 3 illustrate). In some example embodiments, the piezochromic tape 700 is placed over the line 35 and adheres to the line 35. In some example embodiments, the piezochromic tape 700 adheres the pickleball court 20 adjacent the line 35, without covering the line 35.

In some example embodiments, the line 35 comprises the piezochromic powder 710. For instance, the piezochromic powder 710 can be mixed with a white paint, and the white paint can be painted on the pickleball court 20 to form the line 35. Thus, the piezochromic powder 710 can be embedded in the line 35.

In some example embodiments, the piezochromic powder 710 is mixed with the color coating 430 that FIG. 4 illustrates. Thus, the piezochromic powder 710 can be embedded in the color coating 430. Accordingly, the color coating 430 can comprise piezochromic coating 200.

Example 2

In some examples, the piezochromic coating 200 can be practiced utilizing disclosure of the '286 Application comprising the disclosure of paragraph headed "EXAMPLE 2." A piezochromic ink can be formulated by adding 43 parts of 3-(2,2-bis(1-ethyl-2-methylindol-3-yl) vinyl)-3-(4-diethylaminophenyl)-phthalide to 101 parts of undecanoic acid, 144 parts of a urethane alkyd resin, and 8.7 parts of a drier at room temperature. The piezochromic coating 200 can comprise the piezochromic ink that is applied to selected areas of the pickleball court or that is applied to a tape (for example via coating the tape with the piezochromic ink or via embedded the piezochromic ink in the tape) which is applied to the pickleball court 20.

In some example embodiments, the piezochromic coating 200 comprises a paint. In an example embodiment, the paint comprises four components: the piezochromic material (14.5%), oil, urethane alkyd (polyester modified with fatty acid) resin, and a drier. This formulation shows a 15% piezochromic loading in a paint, 150 g pigment per liter of paint (using density 1 kg/L.)

A method for making that yields approximately 296.7 grams comprises mixing at room temperature the following four materials:

- Material 1:43 g 3-(2,2-bis(1-ethyl-2-methylindole-3-yl) vinyl)-3-(4-diethylaminophenyl)-phthalide;
- Material 2:101 g undecanoic acid;
- Material 3:144 g urethane alkyd resin, in clear or white (white is commercially available from The Sherwin-Williams Company of Cleveland Ohio, labeled and marketed as Pro Industrial Waterbased Alkyd Urethane Enamel); and
- Material 4:8.7 g of a drier, catalyst to accelerate the autoxidation process (without a drying catalyst the polymer cross-linking process is relatively slow, with driers the formation of a hard film can be accomplished within a few hours). The drier can comprise: (a) cobalt octoate, CAS Number 136-52-7, available from American Elements of Los Angeles, California; or (b) calcium sulfate CaSO4 dihydrate desiccant, CAS Number 10101-41-4, available from: Thermo Fisher Scientific Inc. of Waltham, Massachusetts under Catalog Number 033301.A1.

Example 3

In some examples, the piezochromic coating 200 can be practiced utilizing disclosure of the '286 Application comprising the disclosure of paragraph and headed "EXAMPLE 3." A piezochromic ink can be formulated by combining 60.6 parts of 3-(2,2-bis(1-ethyl-2-methylindol-3-yl) vinyl)-3-(4-diethylaminophenyl)-phthalide to 51.2 parts of undecanoic acid, 115 parts of an urethane alkyd resin, 16.6 parts of natural calcium carbonate, 2 parts of a cobalt driers mixture, 2 parts of Durham manganese 10, and 2 parts of Zirconium HF grades at room temperature.

A method for making, with 24.2% piezochromic loading catalyst driers, that yields approximately 249.1 grams comprises mixing at room temperature the following six materials:

- Material 1:60.3 g 3-(2,2-bis(1-ethyl-2-methylindole-3-yl) vinyl)-3-(4-diethylaminophenyl)-phthalide;
- Material 2:51.2 g undecanoic acid;
- Material 3:115 g urethane alkyd resin;
- Material 4:16.6 g natural calcium carbonate, CAS Number 471-34-1, finely ground white powder (commercially available from Cole Parmer of Vernon Hills, Illinois under Manufacturer Number C1074-500GM/ Item Number EW-80042-17);
- Material 5:2 g cobalt driers, e.g., cobalt octoate, CAS Number 136-52-7;
- Material 6:2 g Durham manganese 10, a low viscosity, red-brown colored paint drier made with manganese carboxylate (CAS Number 15956-58-8), saturated branched-chain synthetic fatty acid (CAS Number 149-57-5), and an aliphatic hydrocarbon solvent (CAS Number 64742-48-9) (available from: Huntsman Corporation of The Woodlands, Texas); and Material 7:2 g zirconium HF grade.

Example 4

In some examples, the piezochromic coating 200 can be practiced utilizing disclosure of the '286 Application comprising the disclosure of paragraph and headed "EXAMPLE 4." A piezochromic ink can be formulated by adding 40 parts of 3-dibutylamino-6-methyl-7-anilino-fluoran to 100 parts of undecanoic acid, 150 parts of ultra-violet curable ink vehicle, 27 parts of a photoinitiator, 40 parts of hexamethylene diacrylate, and 30 parts of an acrylated amine oligomer hexamethylene diacrylate at room temperature. The piezochromic ink can be sprayed, screened, or brush-applied to form the line 30 or applied over the line 30 and cured with an ultraviolet lamp. The applied piezochromic coating 200 can appear white as applied. When the piezochromic coating 200 is struck by a pickleball 50, a mark 25 at the bounce point 10 can appear gray or dark gray. The piezochromic coating 200 can be reversible, with the mark 25 transitioning from gray back to white over time. In some example embodiments, the piezochromic ink can be formulated into a urethane alkyd resin, for example at approximately ten percent ink and 90 percent resin.

Smolecule Inc. is a commercial source of 3-dibutylamino-6-methyl-7-anilino-fluoran (IX), CAS Number 89331-94-2, C35H36N2O3, under Catalog Number S611815. IUPAC Name: 2'-anilino-6'-(dibutylamino)-3'-methylspiro [2-benzofuran-3,9'-xanthene]-1-one. Smolecule Inc. has an address of 10720 Sentinel Street, San Antonio, Texas 78217 and a phone number of (512) 262-9938.

Kustom Group of Richwood, Kentucky is a commercial source of UV curable ink vehicle.

Sigma-Aldrich of St. Louis, Missouri is a commercial source of hexamethylene diacrylate, CAS Number 13048-33-4, under the Product Number 246816.

Example embodiments of the photoinitiator can comprise: a) lithium phenyl-2,4,6-trimethylbenzoylphosphinate (LAP) or b) water-dispersible photoinitiator nanoparticles of diphenyl(2,4,6-trimethylbenzoyl) phosphine oxide (TPO). (Sigma-Aldrich is a commercial source.)

Arkema Coating Resins of Alsip, Illinois 60803 is a commercial source of acrylated amine oligomer hexamethylene diacrylate.

Example 5

In some example embodiments, those of ordinary skill in the art having benefit of the teaching provided herein can practice the piezochromic coating 200 utilizing the teaching provided herein and their ordinary skill in combination with disclosure present in U.S. Pat. No. 10,345,278, entitled "High Pressure Processing Pressure Sensor," issued Jul. 9, 2019, and identifying as assignee Chromatic Technologies, Inc. of Colorado Springs, Colorado (hereinafter "the '278 Patent"), the entire contents of which are hereby incorporated herein by reference.

For instance, the piezochromic coating 200 can comprise capsules or microcapsules, each of which encapsulates a dye, a developer, and a solvent. In some example embodiments, the dye comprises a leuco dye. In some example embodiments, the leuco dye can switch between two chemical forms, one of which is colorless (the leuco form). In some example embodiments, the leuco dye can comprise crystal violet lactone, pigment blue 63, 2'-(dibenzylamino)-6'-(diethylamino) fluoran, or other appropriate material, without limitation. In some example embodiments, the developer can comprise 3,5-di-tert-butylcatechol, 4,4'-(1,3-dimethylbutylidene)diphenol, 2,2'-biphenol, or other appropriate material, without limitation. In some example embodiments, the solvent controls a reversible interaction between the dye and the developer. In some example embodiments, the dye and the developer are soluble in the solvent. In some example embodiments, the solvent comprises a hydrocarbon. In some example embodiments, the solvent comprises a ketone.

Crystal violet lactone, CAS Number 1552-42-7, is commercially available under Product Number C0741 from Tokyo Chemical Industry Co., LTD of Tokyo, Japan (US division named TCI America having a phone number of 800-423-8616).

Pigment blue 63, CAS Number 16521-38-3, C16H10N208S2, is commercially available under Catalog Number 16521-38-3 from BOC Sciences/BOCSCI Inc.

3,5-di-tert-butylcatechol, CAS Number 1020-31-1, is commercially available from Ambeed, Inc. of Arlington Heights, Illinois, having a phone number of 630-580-1088.

4,4'-(1,3-dimethylbutylidene)diphenol, CAS Number 6807-17-6, is commercially available from Ambeed, Inc.

2,2'-biphenol, (XIX), CAS Number 1806-29-7, is commercially available from TCI America.

The developer can variably interact with the dye according to pressure applied to the piezochromic coating 200. When the applied pressure reaches a threshold pressure level, a visible color change can occur. In some example embodiments, the color change occurs without necessarily rupturing the capsules or microcapsules. In some example embodiments, the threshold pressure level can be selected to be below the pressure that a pickleball 50 typically applies to a pickleball court 20 upon impact and bounce during a pickleball game. Thus, a pickleball bounce can produce a mark 25 as illustrated in FIG. 1 and discussed above. In some example embodiments, the threshold pressure level can further be selected to be above the pressure that a sole of a pickleball player's shoe typically applies to the pickleball court 20 during a pickleball game as the player moves in the court 20. Thus during play, pickleball bounces can leave marks 25 while shoe contact avoids leaving marks.

In some example embodiments, the dye can be formulated at ten percent with undecanoic acid or with urethane alkyd resin. Undecanoic acid (CAS Number 112-37-8) is commercially available from BOCSCI Inc. Urethane alkyd resin is commercially available from Arkema Coating Resins.

Example 6

In some example embodiments, those of ordinary skill in the art having benefit of the teaching provided herein can practice the piezochromic coating 200 utilizing the teaching provided herein and their ordinary skill in combination with disclosure present in US Patent Application Publication Number 2013/0231242, entitled "Pressure Sensitive Coating for Image Forming," published Sep. 5, 2013, and identifying as applicant Chromatic Technologies, Inc. of Colorado Springs, Colorado (hereinafter "the '242 Application"), the entire contents of which are hereby incorporated herein by reference.

For instance, the piezochromic coating 200 can comprise a mixture of microcapsules that have frangible walls and that contain materials which interact with one another to produce a color change or visible indication when an applied force ruptures the microcapsules. For instance, a first portion of the microcapsules can contain a leuco dye, and a second portion of the microcapsules can contain a developer for the leuco dye. When the pickleball 50 strikes the piczochromic coating 200, the microcapsules can rupture at the impact site, thereby releasing leuco dye and developer within the piezochromic coating 200. The released leuco dye and developer can react with one another and produce a color change at the impact site, resulting in the mark 25.

In some example embodiments, the leuco dye and the developer are selected to match color of the piezochromic coating 200 to the color of the area of the pickleball court 20 where the coating 200 is to be applied. In some example embodiments, the piezochromic coating 200 is directly applied to the pickleball court 20 and adheres directly to the pickleball court 20. In some example embodiments, a primer is applied to the pickleball court 20 to promote adhesion, and the piczochromic coating 200 is applied on top of the primer. In such embodiments, the piezochromic coating 200 adheres to the pickleball court 20. In some example embodiments, the piezochromic coating 200 is applied to a tape, and the tape is applied to the court 20. For example, players may purchase a roll of such tape and apply the tape to the court 20 in advance of play, whereby the tape forms the piezochromic coating 200.

Examples 7 and 8

In some example embodiments, those of ordinary skill in the art having benefit of the teaching provided herein can practice the piezochromic coating 200 utilizing the teaching provided herein and their ordinary skill in combination with disclosure present in U.S. Pat. No. 9,592,694, entitled "Pressure Sensitive Coating for Image Forming," issued Mar. 14, 2017, and identifying as applicant and assignee Chromatic Technologies, Inc. of Colorado Springs, Colorado (hereinafter "the '694 Patent"), the entire contents of which are hereby incorporated herein by reference.

Example 7

In some such embodiments, an elongate substrate can be formed into a roll comprising a piezochromic tape. The elongate substrate can, for instance, comprise paper, woven cloth, nonwoven cloth, or plastic comprising two faces, such as a first face and a second face. The second face and the first face can oppose one another. An adhesive layer can adhere to the first face of the elongate substrate. A microencapsulated pigment can be intermixed with: the adhesive layer; a first coating that is bonded directly to the first face of the substrate, so as to be interposed between the elongate substrate and the adhesive layer; or a second coating that is bonded directly to the second face of the elongate substrate. The microencapsulated pigment can respond to pressure of a pickleball impact to provide a marking that is visible to an observer looking directly at the second side of the elongate substrate (so that the observer and the adhesive layers are on opposite sides of the elongate substrate).

The piezochromic tape can comprise an embodiment of the piezochromic coating 200 that is applied to the pickleball court 20. In some embodiments the piezochromic tape is applied using a soft foam roller or a squeegee roller. The microencapsulated pigment can be encapsulated in capsules having walls of a selected wall thickness. The wall thickness can be selected so that the capsules rupture at a predetermined level of applied pressure that is above the pressure the piczochromic tape receives as the tape is applied to the pickleball court 20. In such embodiments, the color of the piezochromic tape can remain generally uniform or generally constant before and after the tape is applied to the court 20. The wall thickness can further be selected so the capsules rupture at a predetermined level of applied pressure that is below the pressure the piezochromic tape receives when a pickleball 50 strikes the tape during pickleball play. Accordingly, the piezochromic tape can respond to a pickleball bounce with a mark 25 that indicates location of the pickleball bounce.

Example 8

In some example embodiments, one of ordinary skill in the art having benefit of the teaching provided herein can practice the piezochromic coating 200 without a tape utilizing the teaching provided herein and such ordinary skill in combination with disclosure provided by the '694 Patent. A piczochromic coating composition can be produced by a method that comprises: encapsulating a colorant and a solvent within pressure-rupturable microcapsules, said colorant and said solvent providing a first color; and combining the pressure-rupturable microcapsules with a developer to form the piezochromic coating composition, wherein said piczochromic coating composition is operable to undergo a color change from said first color to a second color responsive to rupturing the pressure-rupturable microcapsules to expose the solvent and the colorant to the developer. In some example embodiments, the colorant is absent. In some example embodiments, the piczochromic coating composition further comprises second pressure-rupturable microcapsules and the developer is encapsulated within the second pressure-rupturable microcapsules, wherein upon rupture of said pressure-rupturable microcapsules and said second pressure-rupturable microcapsules, said colorant and said solvent combine with said developer to generate said color change from said first color to said second color. The piezochromic coating composition can be coated on the pickleball court 20. In some example embodiments, an acrylate or painted surface of the pickleball court 20 can comprise the piezochromic coating composition, for instance blended with an acrylate material that forms the court 20. When a pickleball 50 bounces from a surface of the pickleball court 20 that comprises the piczochromic coating 200, the pressure-rupturable microcapsules can rupture to produce a mark 25 at the bounce point 10.

Example 9

In some example embodiments, those of ordinary skill in the art having benefit of the teaching provided herein can practice the piezochromic coating 200 utilizing the teaching provided herein and their ordinary skill in combination with disclosure present in International Patent Application Publication Number WO 2018/115654 A1, entitled "Reversible Piezochromic Coating Having a Polymer Matrix for Detecting Impacts on Composite Substrates," published Jun. 28, 2018, and identifying Airbus Group SAS of France and Olikrom of France as assignees (hereinafter "the '654 Application"), the entire contents of which are hereby incorporated herein by reference.

U.S. Provisional Patent Application No. 63/506,364, which is incorporated herein by reference, contains a copy of the '654 Application as Appendix E and a machine translation of the '654 Application as Appendix F.

For instance, the piczochromic coating 200 can comprise a matrix in which at least one piezochromic pigment is dispersed. The matrix can comprise a polymer matrix. The piezochromic pigment can be chosen so that the coating 200 changes color from a determined pressure threshold, corresponding to a pressure, either of transition between two polymorphic states of said pigment in said matrix, or of transition of a spin of said pigment in said matrix. In some example embodiments, the polymer matrix consists of polyurethane. In some example embodiments, the polymer matrix comprises polyurethane. In some example embodiments, the polymer matrix consists of epoxy. In some example embodiments, the polymer matrix comprises epoxy. In some example embodiments, the polymer matrix consists of glycerol. In some example embodiments, the polymer matrix comprises glycerol. In some example embodiments, the piezochromic pigment comprises a metal oxide of formula $AM_OO_4$ wherein A comprises a metal. In some example embodiments, the metal comprises zinc, iron, or nickel. In some example embodiments, the piezochromic pigment is doped with tungsten. In some example embodiments, the piczochromic pigment is doped with magnesium.

The piczochromic coating 200 can be produced and applied to a pickleball court 20 according to a method that comprises: selecting a piezochromic pigment as a function of a transition pressure according to pressure of a pickleball bounce on the pickleball court; determining a quantity of the piezochromic pigment for producing said coating 200; introducing and mixing of the piezochromic pigment homogeneously in a polymer matrix; and applying the piczochromic coating 200 to the pickleball court. In some example embodiments, the piezochromic coating 200 comprises a paint, ink, or varnish. In some example embodiments, the piezochromic coating 200 is applied via paint brush, roller, spray, spray can, or other appropriate application means.

In some example embodiments, the piezochromic coating 200 can be sourced from Olikrom of 2 Avenue de Canteranne, 33600 Pessac, France, phone number +33(0)5 64 37 13 00.

Example 10

In some example embodiments, the piezochromic coating 200 comprises 5-Methyl-2-[(2-nitrophenyl)amino]-3-thiophenecarbonitrile (also known and referred to as "ROY," as in red-orange-yellow, as will be referenced herein). In some embodiments, the piezochromic coating 200 comprises ROY in crystalline form. In some example embodiments, crystals of ROY are laminated or embedded in a tape. In some example embodiments, crystals of ROY are encapsulated in granules of elastomeric material or synthetic rubber, and the granules are mixed in an acrylic coating that is applied to the pickleball court 20 to form the piezochromic coating 200. In some example embodiments, the resulting ROY-based piezochromic coating 200 is overcoated with a transparent coating that encapsulates the ROY-based piezochromic coating 200, thereby providing a protective barrier that isolates the ROY from physical contact with the players, the pickleball 50, or other unintended things. In such an embodiment, the ROY-based piezochromic coating 200 and the encapsulating overcoat form a piczochromic coating.

In some example embodiments, ROY can be synthesized via a process that comprises: forming the thiophene ring system as 2-amino-5-methylthiophene-3-carbonitrile via a Gewald reaction using propionaldehyde, sulfur, and malononitrile; and reacting the amino group with 2-fluoro-nitrobenzene in tetrahydrofuran to provide 5-methyl-2-[(2-nitrophenyl)amino]-3-thiophenecarbonitrile.

In some example embodiments, ROY can be purchased from a commercial source. Representative commercial sources include Smolecule Inc., ChemScense, and Manus Aktteva Biopharma LLP. ROY is available from Smolecule under Catalog Number S570683; CAS No. 138564-59-7.

ChemScence has an address of 1 Deer Park Dr, Suite Q, Monmouth Junction, NJ 08852, USA. ROY is available from ChemScense under Catalog Number CS-W010154.

Manus Aktteva Biopharma LLP has an address of 303, 3rd Floor, Royale Manor, Law Garden, Besides Rangwala Towers, Behind N.C.C. Ground, Dhulia Kot Road, Ellisbridge, Ahmedabad-380006, Gujarat, India and a telephone number of +91 79 26463394.

Example 11

In some example embodiments, the piczochromic coating 200 comprises one or more molecular copper iodide clusters. The molecular copper iodide clusters can, for example, be embedded in a porous polymer or mixed in a paint that is applied to the pickleball court 20 as an example embodiment of the piczochromic coating 200. In some embodiments, the piczochromic coating 200 comprises a copper iodide ligand system.

The molecular copper iodide clusters can be produced in accordance with the disclosure of the paper titled "Molecular Copper Iodide Clusters: A Distinguishing Family of Mechanochromic Luminescent Compounds," by Sandrine Perruchas, published in Dalton Transactions, 2021, 50 (35), pages 12031-12044, the entire disclosure of which is hereby incorporated herein by reference.

In some embodiments, the copper iodide clusters comprise a ligand (L), for example as a Cu4I4L4 cluster. In some embodiments, the ligand is triphenyl phosphene (PPh3), resulting in a Cu4I4 (PPh3)4 cluster.

Synthesis of the clusters can be conducted in solution by reacting copper iodide with the corresponding ligands. The reaction product obtained can comprise a white crystalline powder in relatively high synthesis yields.

The Cu4I4 (PPh3)4 can undergo a visible color change upon application of pressure associated with the pickleball 50 striking the court 20 at the bounce point 10, resulting in the mark 25. In some example embodiments, exposure to a temperature that is above ambient and not more than 100 degrees C. can cause Cu4I4 (PPh3)4 to revert to its native color, thereby effectively erasing the mark 25.

In some example embodiments, players (or maintenance personnel or others) apply heat to the piezochromic coating 200 before a pickleball game (or on a schedule, for example daily or weekly) to reverse existing marks 25 and/or to refresh marking capability of the coating 200, for instance using a heated roller, a heat gun, a heat lamp, or other appropriate heater. In some example embodiments, the heater heats the piezochromic coating 200 to a specified temperature. In some embodiments, the specified temperature is in range of 40 degrees C. to 100 degrees C. In some example embodiments, the heater heats the piczochromic coating 200 to a temperature in range of 60 degrees C. to 80 degrees C.

In some example embodiments, the piezochromic coating 200 comprises a cubane-like Cu4I4 framework in accordance with the disclosure of the paper titled "Flexibility of Cubane-Like Cu4I4 Framework: Temperature Dependence of Molecular Structure and Luminescence Thermochromism of [Cu4I4 (PPh3)4] in Two Polymorphic Crystalline States," by Hakuba Kitagawa, Yoshiki Ozawa, and Koshiro Toriumi, published in Chemical Communications, 2010, 46, 6302-6304, the entire disclosure of which is hereby incorporated herein by reference. In some such embodiments, multitemperature X-ray structure analyses and photoemission spectra of [Cu4I4 (PPh3)4] in two polymorphic crystals reveal that the cubane-like framework is flexibly distorted effecting luminescence thermochromism. In some embodiments, the flexibility of cubane-like Cu4I4 framework can exist in [Cu4I4(PPh3)4] in two polymorphic crystalline states.

Useful technology for marking bounce points has been described. From the description, it will be appreciated that an embodiment of the disclosure overcomes limitations of the prior art. Those skilled in the art will appreciate that the technology is not limited to any specifically discussed application or implementation and that the embodiments described herein are illustrative and not restrictive. Furthermore, the particular features, structures, or characteristics that are set forth may be combined in any suitable manner in one or more embodiments based on this disclosure and ordinary skill. Those of ordinary skill having benefit of this disclosure can make, use, and practice a wide range of embodiments via combining the disclosed features and elements in many permutations without undue experimentation and further by combining the disclosed features and elements with what is well known in the art. This disclosure not only includes the illustrated and described embodiments, but also provides a roadmap for additional embodiments using the various disclosed technologies, elements, features, their equivalents, and what is well known in the art. From the description of the example embodiments, equivalents of the elements shown herein will suggest themselves to those skilled in the art, and ways of constructing other embodiments will appear to practitioners of the art. Therefore, the scope of the technology is to be limited only by the appended claims.

What is claimed is:

1. A system for determining a pickleball bounce point during pickleball play, the system comprising:

a piezochromic coating adhering to a selected area of a pickleball court, wherein the piezochromic coating comprises a piezochromic threshold, wherein the piezochromic threshold is selected to be below a first pressure and above a second pressure, wherein the first pressure comprises pressure of a pickleball impacting the pickleball court and bouncing during the pickleball play, wherein the second pressure comprises pressure a sole of a shoe of a pickleball player applies to the pickleball court as the pickleball player moves about the pickleball court during the pickleball play, and wherein the piezochromic coating comprises a piezochromic tape, the piezochromic tape comprising:

a first tape that is translucent and chemically inert with respect to the pickleball, wherein the first tape comprises an upper surface defining a plane extending horizontally along the upper surface, wherein the upper surface is disposed to contact the pickleball during said pickleball play, and wherein the first tape comprises polyethylene terephthalate;

a second tape that is opaque and that is disposed below the first tape; and an adhesive that is disposed below the second tape and that adheres the piezochromic tape to the selected area of the pickleball court, wherein the piezochromic tape comprises a plurality of materials disposed below the plane and above the adhesive, wherein the plurality of materials are separated from one another when the upper surface is subjected to a third pressure that is below the piezochromic threshold, and wherein the plurality of materials are operative to interact to produce a color change responsive to the upper surface being subjected to a fourth pressure from a pickleball impact that is above the piezochromic threshold.

2. The system of claim 1, wherein the plurality of materials are further operative such that one or more mechanical stimuli applied to the piezochromic tape by said pickleball impact exclusively initiates said color change.

3. The system of claim 1, wherein the selected area of the pickleball court comprises a line that comprises at least one of a side line, a base line, a centerline, and a volley line, wherein the adhesive adheres is adhering the piezochromic tape to the line, and wherein the second tape is colored to match the line.

4. The system of claim 1, wherein the produced color change comprises a mark, and wherein the mark fades with time responsive to conclusion of the pickleball impact and the upper surface no longer being subjected to the fourth pressure.

5. The system of claim 1, wherein the second tape is colored to match the selected area of the pickleball court, wherein at least one material in the plurality of materials comprises metal, and wherein the color change is a reversible color change.

6. The system of claim 1, wherein the piezochromic tape further comprises metal disposed below the first tape and above the adhesive for producing a color change responsive to the pickleball impacting the upper surface and bouncing during said pickleball play.

7. The system of claim 1, wherein the piezochromic tape is operative to undergo a reversible color change during said pickleball play without a chemical reaction occurring between the pickleball and the piezochromic tape.

8. The system of claim 1, wherein the plurality of materials are further operative such that one or more mechanical stimuli applied to the piezochromic tape by said pickleball impact exclusively initiates the color change, wherein the selected area of the pickleball court comprises a line that comprises at least one of a side line, a base line, a centerline, and a volley line, wherein the adhesive adheres the piezochromic tape to the line, wherein the second tape is colored to match the line, wherein the produced color change comprises a mark, wherein the mark fades with time responsive to conclusion of the pickleball impact and the upper surface no longer being subjected to the fourth pressure, and wherein at least one material in the plurality of materials comprises metal.

9. The system of claim 8, wherein the piezochromic coating further comprises:

particles of silica such that the piezochromic coating composes silica in a range of 2 to 10 percent by weight; and granules of elastomeric material such that the piezochromic coating composes elastomeric material in a range of 2 to 10 percent by weight, whereby the particles of silica and the granules of elastomeric material favorably control mechanical properties of coated and uncoated portions of the pickleball court to facilitate uniform play across the pickleball court.

10. The system of claim 8, wherein the piezochromic coating forms a first exterior surface of the pickleball court, wherein a non-piezochromic coating forms a second exterior surface of the pickleball court that is disposed laterally adjacent the first exterior surface of the pickleball court, wherein the piezochromic coating comprises granules of elastomeric material, such that the piezochromic coating composes elastomeric material in a range of 2 to 10 percent by weight, to favorably control mechanical properties of the first exterior surface of the pickleball court relative to mechanical properties of the second exterior surface of the pickleball court to facilitate uniform play across the first and second exterior surfaces of the pickleball court.

11. The system of claim 10, wherein said controlled mechanical properties comprise Leeb rebound hardness, wherein the first exterior surface has a first Leeb rebound hardness, wherein the second exterior surface has a second Leeb rebound hardness, and wherein the first Leeb rebound hardness is within ten percent of the second Leeb rebound hardness, thereby favorably controlling mechanical properties of the first exterior surface of the pickleball court relative to mechanical properties of the second exterior surface of the pickleball court to facilitate uniform play across the first and second exterior surfaces of the pickleball court.

12. The system of claim 8, wherein the piezochromic coating forms a first exterior surface of the pickleball court, wherein a non-piezochromic coating forms a second exterior surface of the pickleball court that is disposed laterally adjacent the first exterior surface of the pickleball court, wherein the piezochromic coating comprises particles of silica, such that the piezochromic coating composes silica in a range of 2 to 10 percent by weight, to favorably control mechanical properties of the first exterior surface of the pickleball court relative to mechanical properties of the second exterior surface of the pickleball court to facilitate uniform play across the first and second exterior surfaces of the pickleball court.

13. The system of claim 12, wherein said controlled mechanical properties comprise kinetic friction coefficient, wherein the first exterior surface has a first kinetic friction coefficient with the pickleball, wherein the second exterior surface has a second kinetic friction coefficient with the pickleball, and wherein the first kinetic friction coefficient is within ten percent of the second kinetic friction coefficient, thereby favorably controlling mechanical properties of the first exterior surface of the pickleball court relative to mechanical properties of the second exterior surface of the pickleball court to facilitate uniform play across the first and second exterior surfaces of the pickleball court.

14. A system for determining a pickleball bounce point during pickleball play, the system comprising:

a piezochromic coating adhering to a selected area of a pickleball court, wherein the piezochromic coating comprises a piezochromic threshold, wherein the piezochromic threshold is selected to be below a first pressure and above a second pressure, wherein the first pressure comprises pressure of a pickleball impacting the pickleball court and bouncing during the pickleball play, wherein the second pressure comprises pressure a sole of a shoe of a pickleball player applies to the pickleball court as the pickleball player moves about the pickleball court during the pickleball play, and wherein the piezochromic coating comprises a piezochromic tape that comprises:

a first tape that is translucent, chemically inert with respect to the pickleball, and disposed to contact the pickleball during said pickleball play;

a second tape that is opaque and that is disposed below the first tape; and an adhesive that is disposed below the second tape and that adheres the piezochromic tape to the selected area of the pickleball court.

15. The system of claim 14, wherein the first tape comprises polyethylene terephthalate, wherein the selected area of the pickleball court comprises a line that comprises at least one of a side line, a base line, a centerline, and a volley line, wherein the adhesive is adhering to the line, and wherein the second tape is colored to match the line, and wherein the piezochromic tape further comprises metal disposed between the first tape and the adhesive for producing a color change responsive to the pickleball impacting the first tape and bouncing during said pickleball play.

* * * * *